US005463535A

United States Patent [19]

Vest

[11] Patent Number: 5,463,535

[45] Date of Patent: Oct. 31, 1995

[54] UMBRELLA POST LIGHT

[76] Inventor: William C. Vest, 380 Lake Shore Dr. #27, Shelby, Ala. 35143

[21] Appl. No.: 310,346

[22] Filed: Sep. 22, 1994

[51] Int. Cl.[6] ..... A45B 3/02

[52] U.S. Cl. ..... 362/102; 362/223; 362/431; 135/16

[58] Field of Search ..... 362/102, 120, 362/202, 217, 223, 431; 135/16, 66, 91

[56] References Cited

U.S. PATENT DOCUMENTS

| | | | |
|---|---|---|---|
| 1,765,911 | 6/1930 | Fabianke | 362/431 X |
| 3,072,784 | 1/1963 | Mann | 362/431 X |
| 3,313,929 | 4/1967 | Schiavone | 362/102 |

FOREIGN PATENT DOCUMENTS

| | | | |
|---|---|---|---|
| 2627846 | 9/1989 | France | 135/91 |
| 3603397 | 5/1987 | Germany | 135/16 |

*Primary Examiner*—Stephen F. Husar

[57] ABSTRACT

A light for illuminating structure around a post. The inventive device includes a main body having a cylindrical lens extending therearound. A lower post coupler is mounted to a first end of the main body and can be coupled to a weighted base of a table umbrella. An upper post coupler is mounted to a second end of the main body and can receive a post of a table umbrella. A light bulb is mounted within the main body to effect lighting of structure around the umbrella post, such as a table or the like.

11 Claims, 5 Drawing Sheets

UMBRELLA POST LIGHT

BACKGROUND OF THE INVENTION

1. Field of the Invention

The present invention relates to light structures and more particularly pertains to an umbrella post light for illuminating structure around a post.

2. Description of the Prior Art

The use of light structures is known in the prior art. More specifically, light structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art light structures include U.S. Pat. No. 4,821,454; U.S. Pat. No. 4,788,995; U.S. Pat. No. 4,174,532; U.S. Pat. No. 3,870,062; and U.S. Pat. No. Des. 283,647.

While these devices fulfill their respective, particular objectives and requirements, the aforementioned patents do not disclose an umbrella post light for illuminating structure around a post which includes a main body having a cylindrical lens extending therearound, a lower post coupler mounted to a first end of the main body for engaging a weighted base of a table umbrella, an upper post coupler mounted to a second end of the main body for receiving the post of a table umbrella, and light bulb mounted within the main body to effect lighting of the table or other structure around the umbrella post.

In these respects, the umbrella post light according to the present invention substantially departs from the conventional concepts and designs of the prior art, and in so doing provides an apparatus primarily developed for the purpose of illuminating structure around a post.

SUMMARY OF THE INVENTION

In view of the foregoing disadvantages inherent in the known types of light structures now present in the prior art, the present invention provides a new umbrella post light construction wherein the same can be utilized for illuminating structure around the post, such as a table top or the like. As such, the general purpose of the present invention, which will be described subsequently in greater detail, is to provide a new umbrella post light apparatus and method which has many of the advantages of the light structures mentioned heretofore and many novel features that result in a umbrella post light which is not anticipated, rendered obvious, suggested, or even implied by any of the prior art light structures, either alone or in any combination thereof.

To attain this, the present invention generally comprises a light for illuminating structure around a post. The inventive device includes a main body having a cylindrical lens extending therearound. A lower post coupler is mounted to a first end of the main body and can be coupled to a weighted base of a table umbrella. An upper post coupler is mounted to a second end of the main body and can receive a post of a table umbrella. A light bulb is mounted within the main body to effect lighting of structure around the umbrella post, such as a table or the like.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new umbrella post light apparatus and method which has many of the advantages of the light structures mentioned heretofore and many novel features that result in a umbrella post light which is not anticipated, rendered obvious, suggested, or even implied by any of the prior art light structures, either alone or in any combination thereof.

It is another object of the present invention to provide a new umbrella post light which may be easily and efficiently manufactured and marketed.

It is a further object of the present invention to provide a new umbrella post light which is of a durable and reliable construction.

An even further object of the present invention is to provide a new umbrella post light which is susceptible of a low cost of manufacture with regard to both materials and labor, and which accordingly is then susceptible of low prices of sale to the consuming public, thereby making such umbrella post lights economically available to the buying public.

Still yet another object of the present invention is to provide a new umbrella post light which provides in the apparatuses and methods of the prior art some of the advantages thereof, while simultaneously overcoming some of the disadvantages normally associated therewith.

Still another object of the present invention is to provide a new umbrella post light for illuminating structure around a post, such as a table top or the like.

Yet another object of the present invention is to provide a new umbrella post light which includes a main body having a cylindrical lens extending therearound, a lower post coupler mounted to a first end of the main body for engaging a weighted base of a table umbrella, an upper post coupler mounted to a second end of the main body for receiving the post of a table umbrella, and light bulb mounted within the main body to effect lighting of the table or other structure around the umbrella post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
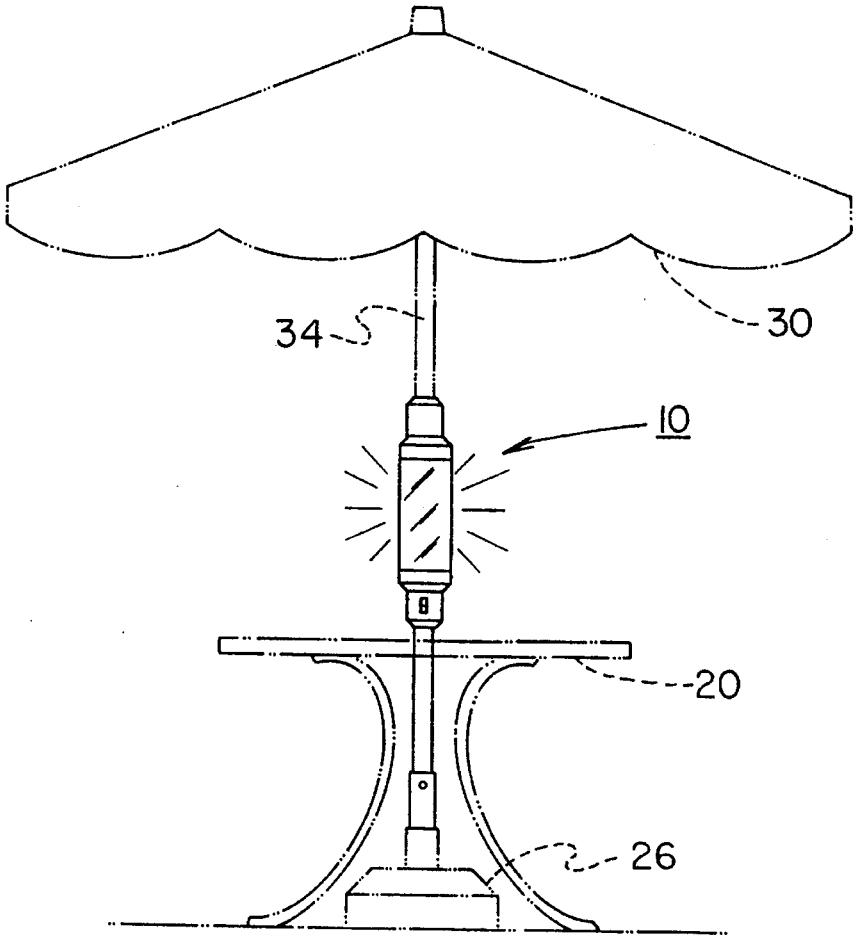
FIG. 1 is a front elevation view of a umbrella post light according to the present invention.

With reference now to the drawings, and in particular to FIGS. 1–8 thereof, a new umbrella post light embodying the principles and concepts of the present invention and generally designated by the reference numeral 10 will be described.

Figure 2:
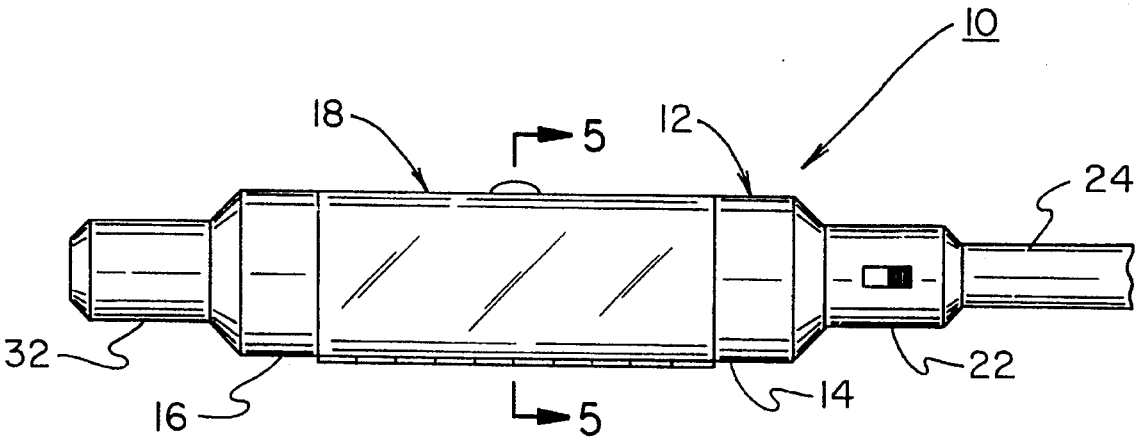
FIG. 2 is a further front elevation view thereof.

More specifically, will be noted that the umbrella post light 10 comprises a substantially cylindrical main body 12 comprising a lower end cap 14 spaced from an upper end cap 16, with a light means 18 interposed between the upper and lower end caps, as best illustrated FIG. 2. The light means 18 is operable to illuminate structure around the main body 12, such as the table 20 illustrated in FIG. 1 for example. To this end, the device 10 further includes a lower post coupler 22 which extends from the lower end cap 14 and couples to a substantially tubular support post 24. The support post 24 is positionable through a center aperture in the table 20 and may be coupled to a weighted base 26 positioned beneath the table by a base coupler 28. By this structure, the light means 18, as well as the main body 12 is positioned above the table 20, whereby the table top and items residing thereon can be illuminated by the light means.

Figure 3:
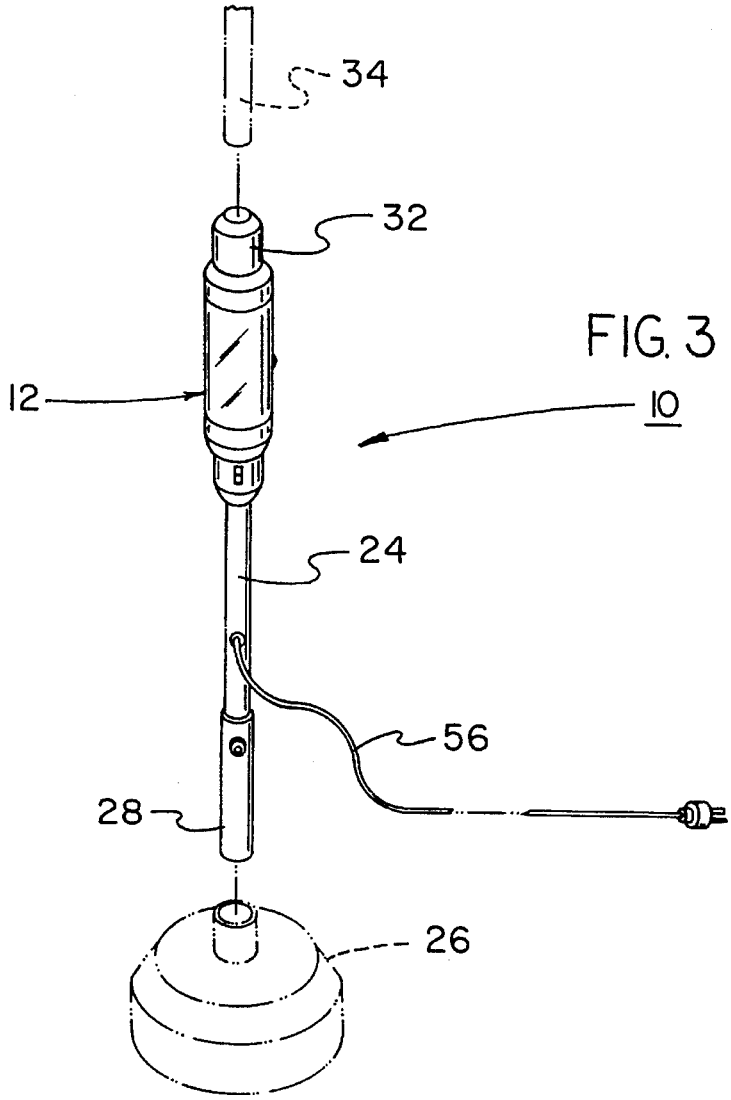
FIG. 3 is an exploded isometric illustration of the light.
Figure 6:
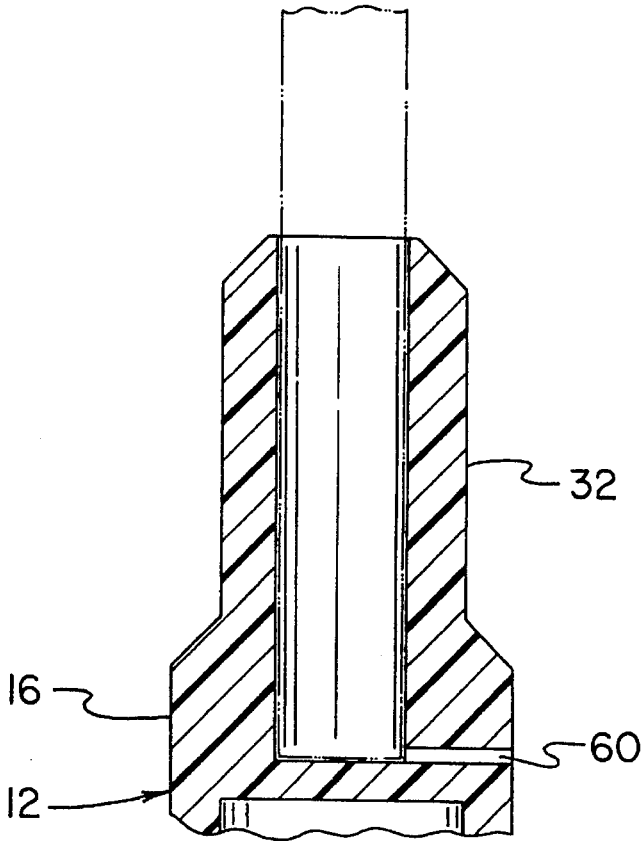
FIG. 6 is a cross sectional view of the upper post coupler.

To facilitate support of a patio umbrella 30 in conjunction with the umbrella post light 10, the device further includes an upper post coupler 32 extending from the upper end cap 16 and arranged to receive an umbrella post 34 of the patio umbrella 30. As shown in FIGS. 3 and 6, the umbrella post 34 is received within the upper post coupler 32 during such coupling.

Figure 4:
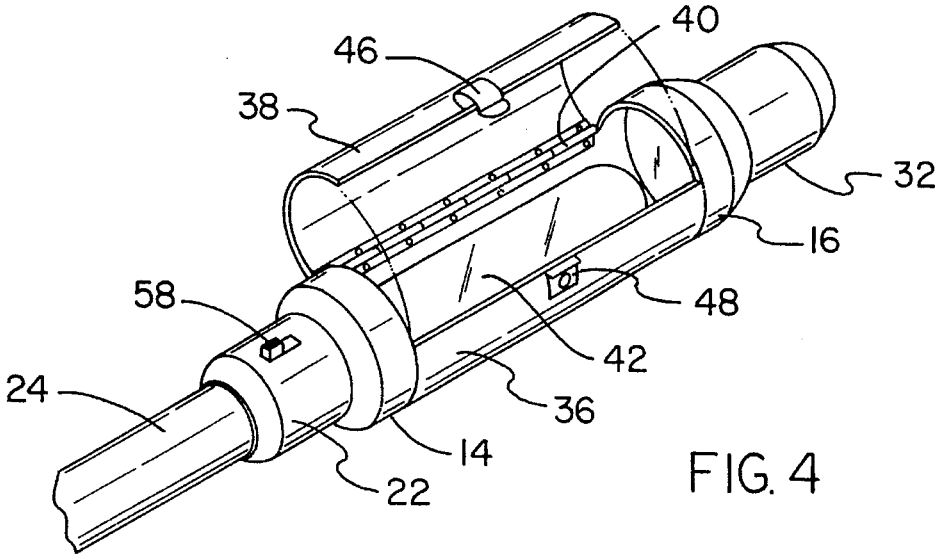
FIG. 4 is an isometric illustration of the present invention showing movement of the lens structure.
Figure 5:
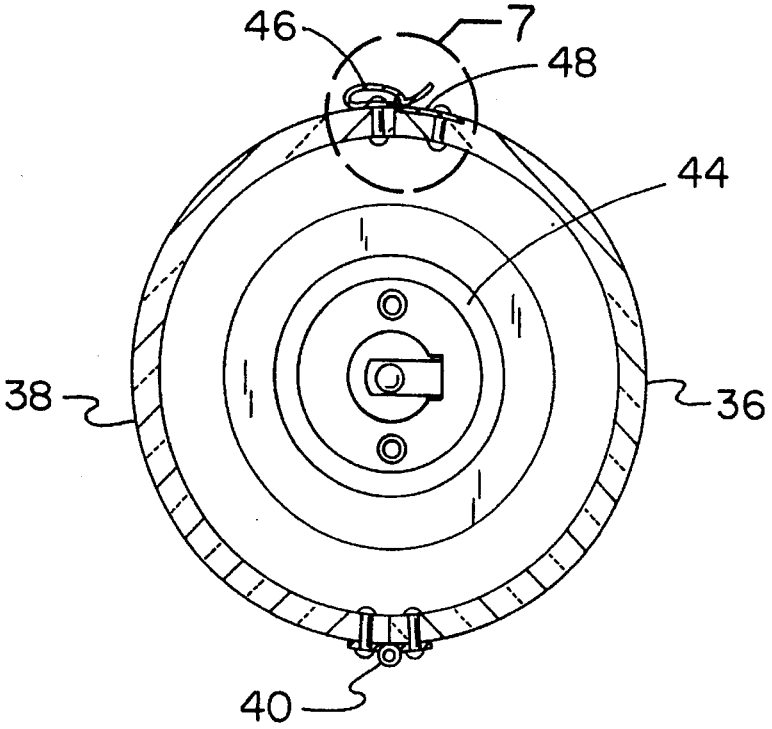
FIG. 5 is a cross sectional view taken along line 5—5 of FIG. 2.

Turning now to FIGS. 4 and 5, it can be shown that the light means 18 preferably comprises a fixed lens 36 of substantially semi-cylindrical configuration which fixedly extends between the upper end cap 16 and the lower end cap 14. A pivotal lens 38 of substantially identical construction to the fixed lens 36 is pivotally mounted to an edge of the fixed lens by a hinge 40 which permits the pivotal lens to be opened as shown in FIG. 4. Opening of the pivotal lens 38 provides an individual with access to an interior of the main body 12 for servicing of a light bulb 42 contained therein. As shown in FIG. 5, a light bulb socket 44 is secured to an interior of the lower end cap 14 and arranged to threadably receive the light bulb 42 to support the same in a vertical orientation. The light bulb 42 may be of the incandescent type, but is preferably a fluorescent light bulb including a looped or u-shaped fluorescent tube.

Figure 7:
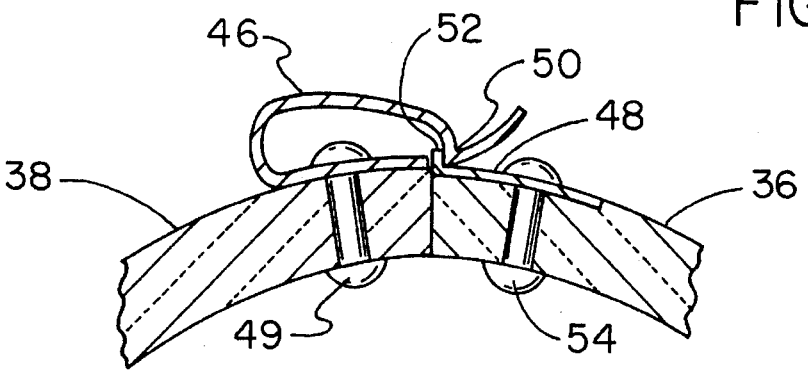
FIG. 7 is a cross sectional illustration of the lens detailing the spring clip closure.

To retain the pivotal lens 38 in a closed position relative to the remainder of the main body 12, a spring clip 46 is secured to the pivotal lens and engages a catch 48 secured to the fixed lens 36. As shown in FIG. 7, the spring clip 46 is secured to the pivotal lens 38 by a rivet 49 which extends through both the spring clip and the pivotal lens. The spring clip 46 includes an integral projection 50 which engages an upstanding lip 52 of the catch 48. Similarly, the catch 48 is secured to the fixed lens 36 by a further rivet 54. By this structure, the pivotal lens can be easily opened to permit access and servicing of the light bulb 42.

Electrical power is supplied to the light bulb socket 44 through a power cord 56 engagable to a conventional household power outlet. The power cord 56 extends through an unlabeled aperture in a side of the support post 24 and extends through an interior of the support post to electrically couple with a power switch 58 mounted along an exterior surface of the lower post coupler 22. The power switch 58 is in electrical communication with the light bulb socket 44 and can be selectively operated by an individual to effect energization of the light bulb 42 as desired.

As shown in FIG. 6, the upper post coupler 32 is preferably provided with a through-extending drain aperture 60 which extends through a side wall of the upper end cap 16 and permits drainage of fluids, such as rain water or the like out of the post receiving cavity of the upper post coupler. The drain aperture 60, by allowing rain water and the like to drain from the upper post coupler 32, effectively reduces corrosion of the umbrella post 34.

Figure 8:
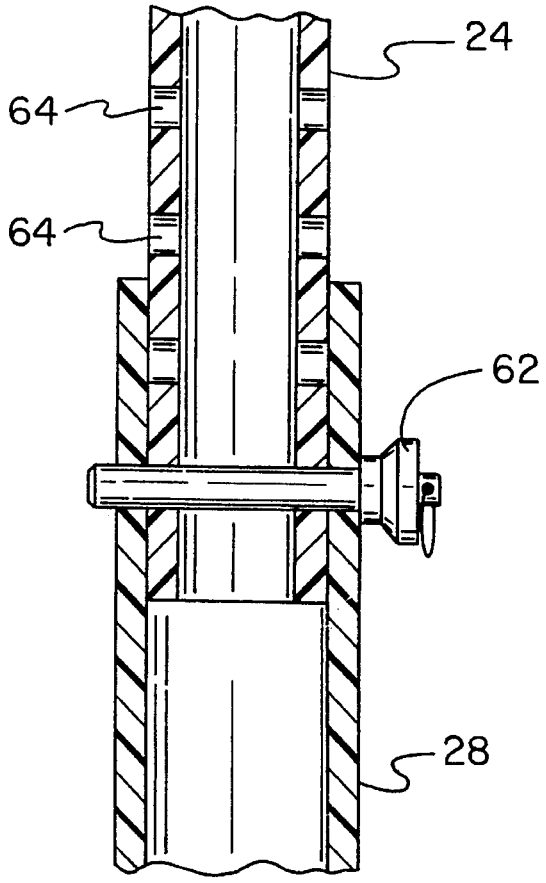
FIG. 8 is a cross sectional view detailing the adjustable engagement of the base coupler to the support post.

Referring now to FIG. 8, it can be shown that the base coupler 28 can additionally be adjustably coupled to the support post 24 by a removable pin 62. To this end, the support post 24 advantageously includes a plurality of aligned, through-extending pin apertures 64 through, any one of which the pin 62 can be selectively positioned. Thus, the pin 62 can be positioned so as to extend through a single unlabeled aperture in the base coupler 28 and through any of the pin apertures 64 as described above. By this structure, the light means 18 of the main body 12 may be positioned at a desired height relative to the table 20.

Figure 9:
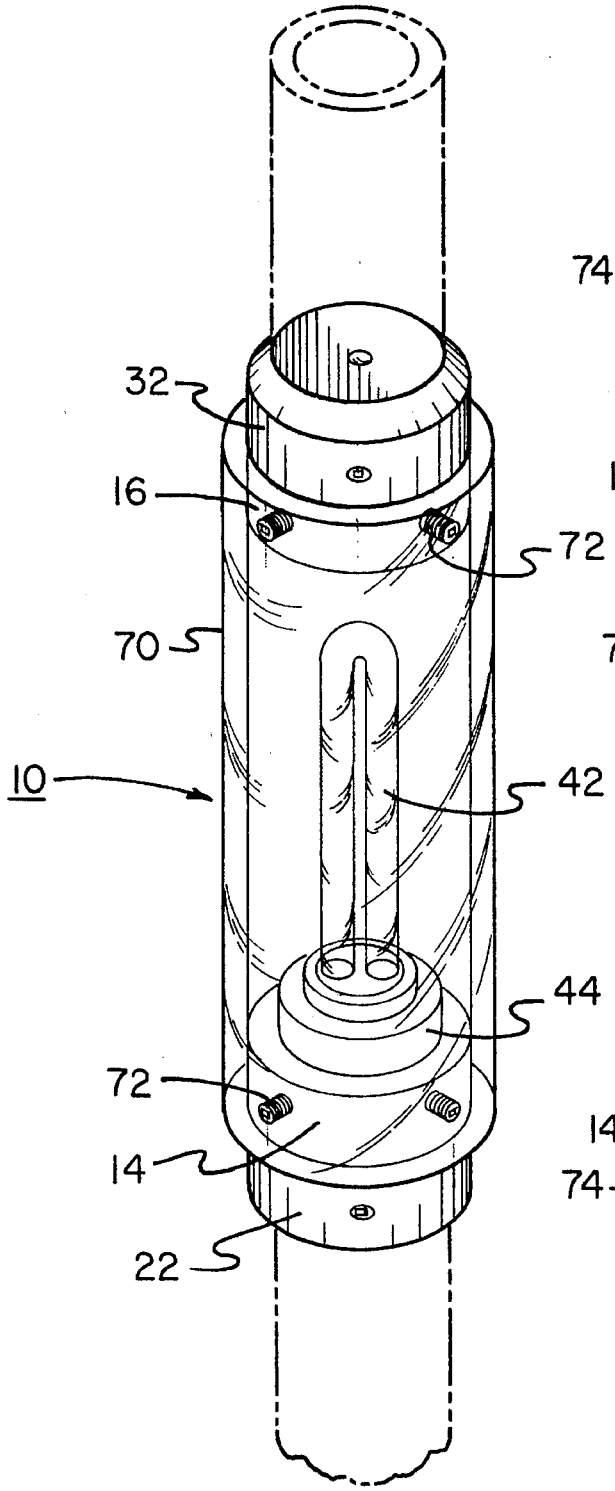
FIG. 9 is an isometric illustration of the present invention showing an alternative form of the light means.
Figure 10:
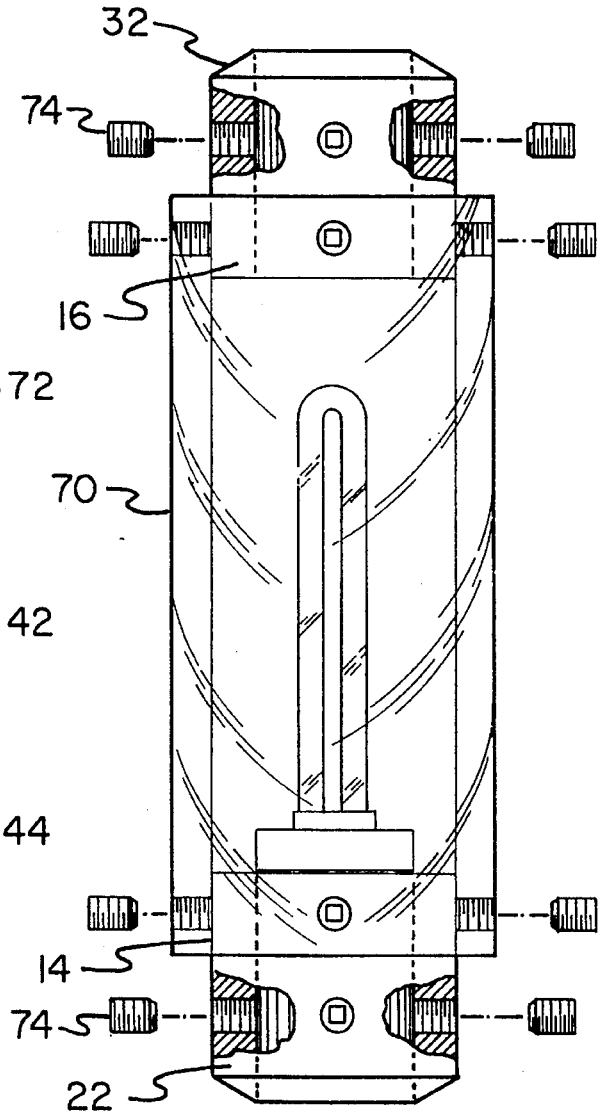
FIG. 10 is a side elevational view, partially in cross section, detailing the alternative form of the light means and showing a plurality of set screws directed into the upper and lower end caps, as well as the upper and lower post couplers.

FIGS. 9 and 10 illustrate an alternative form of the present invention 10 and it can be shown from these figures that the light means 18 of the umbrella post light, in lieu of the a fixed lens 36 and the pivotal lens 38, may alternatively comprise a solid cylindrical lens 70 which offers greater support and rigidity to the structure of the device 10. In this alternative form of the invention 10, the lower end cap 14 and the lower post coupler 22 are integrally formed from a single length of tubing. Similarly, the upper end cap 16 and the upper post coupler 32 are also formed from an additional single length of tubing. The lower end cap 14 and its associated lower post coupler 22, as well as the upper end cap 16 and its associated upper post coupler 32 are removably coupled to the solid cylindrical lens 70 by a plurality of set screws 72 threadably directed through the solid cylindrical lens. To facilitate securement of the post couplers 22, 32 to the associated posts, a further plurality of set screws 74 are also provided.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An umbrella post light comprising;

a main body having a lower end cap spaced from an upper end cap;

lighting means interposed between said upper and lower end caps for creating and dispensing light exteriorly of said main body;

a lower post coupler extending from said lower end cap;

an upper post coupler extending from said upper end; and a substantially tubular support post coupled to said lower post coupler, said support post being coupled to a base coupler, with said base coupler being couplable to a weighted base positioned beneath a table such that said lighting means is positioned above said table, whereby said table and items residing thereon can be illuminated by said lighting means.

2. The umbrella post light of claim 1, wherein said lighting means comprises a fixed lens of substantially semi-cylindrical configuration which fixedly extends between said upper end cap and said lower end cap; a pivotal lens of substantially semi- cylindrical configuration pivotally mounted to an edge of said fixed lens; a light bulb socket secured to an interior of said main body for threadably receiving a light bulb; and power cord means electrically coupled to said light bulb socket for electrically communicating said socket with a power source.

3. The umbrella post light of claim 2, and further comprising a spring clip secured to said pivotal lens; and a catch secured to said fixed lens, said spring clip being selectively engagable to said catch to retain said pivotal lens relative to said fixed lens.

4. The umbrella post light of claim 3, wherein said power cord means comprises a power cord engagable to a conventional household power outlet; a power switch mounted to said main body with said power cord extending through an aperture in a side of said support post and being in electrical communication with said power switch, said power with being in electrical communication with said socket for selectively permitting electrical communication between said power cord and said socket.

5. The umbrella post light of claim 4, wherein said base coupler is adjustably coupled to said support post by a removable pin, said support post including a plurality of aligned, through-extending pin apertures, and said base coupler including a through-extending aperture, wherein said pin can be selectively positioned through said apertures.

6. The umbrella post light of claim 5, and further comprising a light bulb threadably engaged to said socket, said light bulb comprising an incandescent light bulb.

7. The umbrella post light of claim 5, and further comprising a light bulb threadably engaged to said socket, said light bulb comprising a fluorescent light bulb having u-shaped fluorescent tube.

8. An umbrella post light comprising:

a main body having a lower end cap spaced from an upper end cap;

a lower post coupler extending from said lower end cap;

an upper post coupler extending from said upper end cap, said upper post coupler having a through-extending drain aperture extending through a side wall of said upper end cap;

a substantially tubular support post coupled to said lower post coupler;

a base coupler adjustably coupled to said support post, said base coupler being couplable to a weighted base, said support post including a plurality of aligned, through-extending pin apertures, and said base coupler including a through-extending aperture with a pin positioned through base coupler aperture and an individual one of said support post apertures;

a light means interposed between said upper and lower end caps for creating and dispensing light exteriorly of said main body, said light means comprising a fixed lens of substantially semi-cylindrical configuration which fixedly extends between said upper end cap and said lower end cap; a pivotal lens of substantially semi-cylindrical configuration pivotally mounted to an edge of said fixed lens; a light bulb socket secured to an interior of said main body for threadably receiving a light bulb; and power cord means electrically coupled to said light bulb socket for electrically communicating said socket with a power source, said power cord means comprising a power cord engagable to a conventional household power outlet; a power switch mounted to said main body with said power cord extending through an aperture in a side of said support post and being in electrical communication with said power switch, said power with being in electrical communication with said socket for selectively permitting electrical communication between said power cord and said socket;

and, a spring clip secured to said pivotal lens; and a catch secured to said fixed lens, said spring clip being selectively engagable to said catch to retain said pivotal lens relative to said fixed lens.

9. The umbrella post light of claim 8, and further comprising a light bulb threadably engaged to said socket, said light bulb comprising an incandescent light bulb.

10. The umbrella post light of claim 8, and further comprising a light bulb threadably engaged to said socket, said light bulb comprising a fluorescent light bulb having u-shaped fluorescent tube.

11. An umbrella post light comprising:

a main body having a lower end cap spaced from an upper end cap;

a lower post coupler extending from said lower end cap;

an upper post coupler extending from said upper end cap, said upper post coupler having a through-extending drain aperture extending through a side wall of said upper end cap;

a substantially tubular support post coupled to said lower post coupler;

a base coupler adjustably coupled to said support post, said base coupler being couplable to a weighted base, said support post including a plurality of aligned, through-extending pin apertures, and said base coupler including a through-extending aperture with a pin positioned through base coupler aperture and an individual one of said support post apertures;

and, a light means interposed between said upper and lower end caps for creating and dispensing light exteriorly of said main body, said light means comprising a solid cylindrical lens which fixedly extends between said upper end cap and said lower end cap; a light bulb socket secured to an interior of said main body for threadably receiving a light bulb; and power cord means electrically coupled to said light bulb socket for electrically communicating said socket with a power source, said power cord means comprising a power cord engagable to a conventional household power outlet; a power switch mounted to said main body with said power cord extending through an aperture in a side of said support post and being in electrical communication with said power switch, said power with being in electrical communication with said socket for selectively permitting electrical communication between said power cord and said socket.

* * * * *